United States Patent [19]

Groves et al.

[11] 3,993,039

[45] Nov. 23, 1976

[54] COMPOUND ARCHER BOW

[75] Inventors: Harold W. Groves; Mark J. Davis; D. Richard Anderson, all of Albuquerque, N. Mex.

[73] Assignee: Sandia Sports, Inc., Albuquerque, N. Mex.

[22] Filed: Mar. 10, 1975

[21] Appl. No.: 557,129

Related U.S. Application Data

[63] Continuation of Ser. No. 415,544, Nov. 11, 1973, abandoned.

[52] U.S. Cl. ..... 124/23 R; 124/90; 273/DIG. 7

[51] Int. Cl.[2] ..... F41B 5/00

[58] Field of Search ..... 124/23 R, 24 R, 30 A, 124/30 R, 21, 22

[56] References Cited

UNITED STATES PATENTS

| | | | |
|---|---|---|---|
| 3,595,213 | 4/1969 | Storer | 124/23 R |
| 3,812,835 | 5/1974 | Smith | 124/24 R |
| 3,851,638 | 12/1974 | Alexander | 124/24 R |

*Primary Examiner*—Richard C. Pinkham
*Assistant Examiner*—William R. Browne

[57] ABSTRACT

An archery apparatus including a mechanism for storing and releasing energy in multiple directions along the limbs of a limb and hand grip assembly. The mechanism for storing and releasing energy are elongated members running longitudinally of the bow limbs and on different sides of the limbs.

An archery apparatus including composite eccentric members and sheaves which effect coordinated changes in direction of energy storage and release. The eccentric members are positioned adjacent the bow handle and rotate when tension is applied to the bow string, the latter being connected to the energy storing and releasing device. Sheaves may be drivingly connected to each other and to the eccentric members so that the bow limbs will deflect equally when a tension force is applied to the bow string.

9 Claims, 10 Drawing Figures

Figure 6:
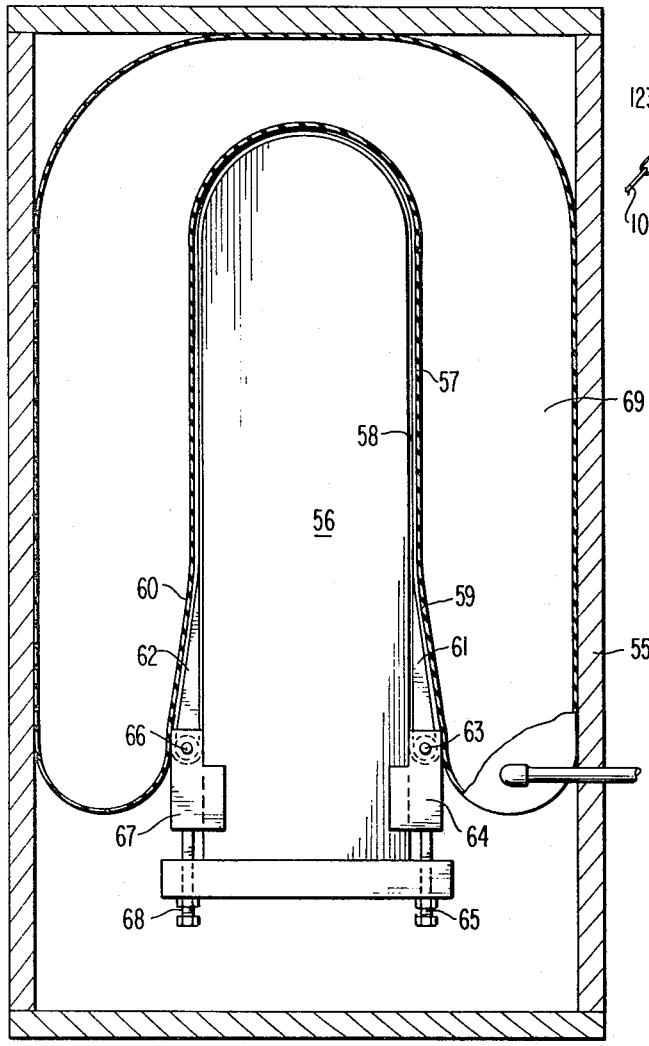

FIG.1
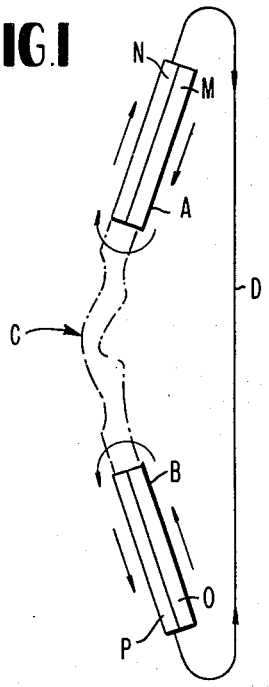
FIG.3
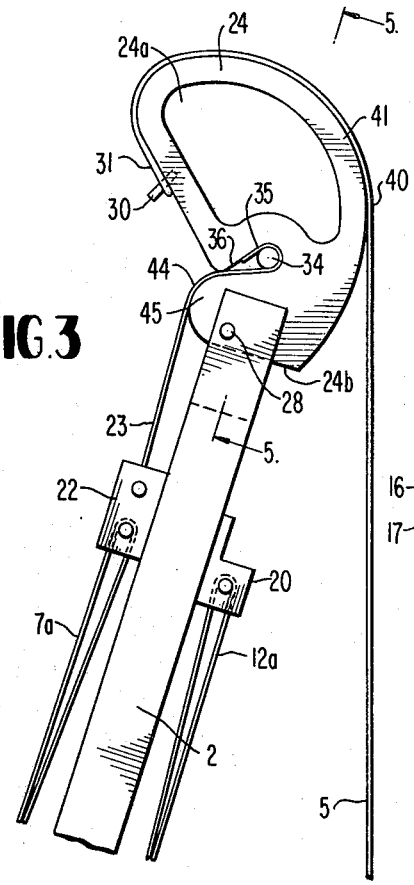
FIG.2
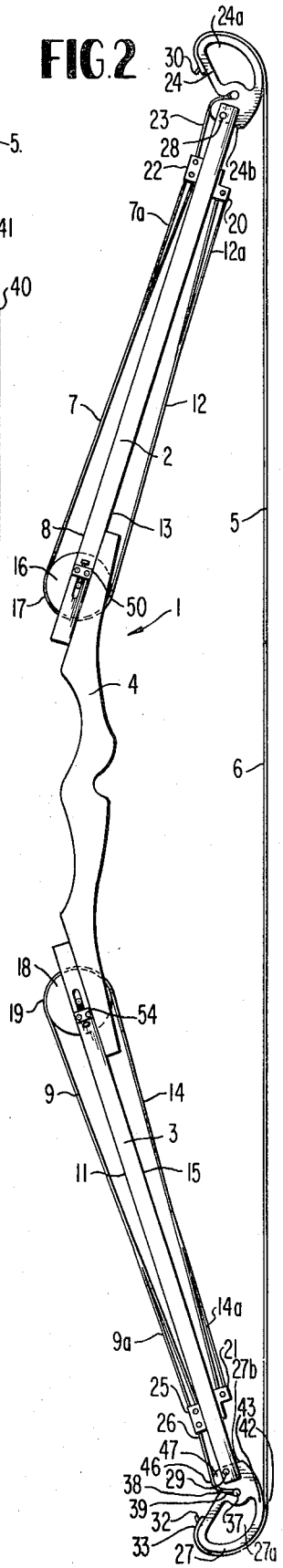
FIG.4
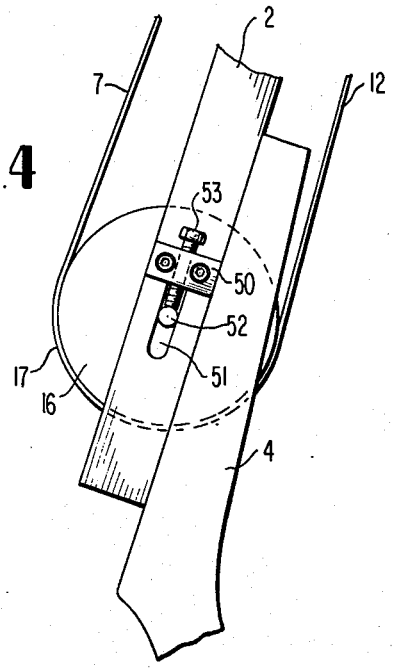
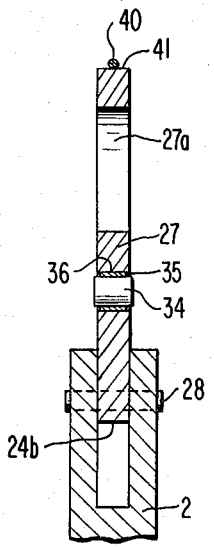
FIG.5

COMPOUND ARCHER BOW

RELATED APPLICATION

This application is a continuation of application Ser. No. 415,544, filed Nov. 11, 1973, and abandoned Aug. 21, 1975.

GENERAL BACKGROUND, OBJECTS AND SUMMARY OF INVENTION

Archery is an ancient art replete with efforts to provide improved structures contributing to efficiency and ease of handling of archery instruments and overall accuracy in their use.

One technique for achieving improvements in archery entails concepts for reducing the holding force when a bow string is extended, so as to reduce the strain imposed upon an archer as he is readying the release of an arrow and taking aim. This basic concept is described, for example, in pages 53, 63 and 67 and in other portions of an article entitled "Archery", edited by Hickman et al and published by the National Field Archery Association in 1947.

An effort at utilizing this prior at concept is set forth in a previous Allen U.S. Pat. No. 3,486,495. However, the Allen system is characterized by a compound pulley and multiple pulley line system which creates a structural arrangement where multiple pulley strings are interposed between a bow string nocking zone and a bow hand grip.

The present invention departs entirely from the Allen concept and provides a technique for improving efficiency and handling in archery instruments by utilizing a multi-directional energy storing system.

It is a principal object of the invention to provide energy storing means extending longitudinally along bow limb means in such a manner as to not obstruct a nocking zone and maintain a single bow string extending between the tips of the bow limbs.

It is also an object of the invention to provide a unique, eccentrically mounted, force transmitting, cam-lever means, which as an optional objective, may be selectively detachable if desired so as to permit the "tailoring" of bow characteristics to the requirements of individual archers. Yet another, and optional, object of the invention is to provide, through the cam-lever means, a mechanism which will indicate to the archer the optimum termination of bow string pulling, i.e., provide in essence a pull "stop".

Another object of the invention is to provide an energy storing system of the type heretofore described which is characterized by a relatively low distension of energy storing means so as to minimize release reaction force generated movements.

In accomplishing at least some of these basic objectives the invention contemplates an archery apparatus including a limb and hand grip assembly comprising a first limb structure, a second limb structure, and a hand grip structure. The hand grip structure interconnects the first and second limb structures, with the first and second limb structures extending generally oppositely away from the hand grip structure. A bow string structure extends between the first and second limb structures and provides a nocking zone operable to engage an arrow.

The improvement of the present invention comprises a multidirectional energy storing and release system including an energy storing assembly having first elongate energy storing means, extending longitudinally along at least one of the limb means and other elongate energy storing means extending longitudinaly along this limb means. An energy transfer means is operable to interconnect the first and other elongate energy storing means in force transmitting communication and afford a multidirectional storage and releasing of energy.

An anchor means may connect a first end of the interconnected first and other elongate energy storing means with the limb and hand grip assembly. A force transmitting, connecting means connects a second end of the interconnected first and other elongate energy storing means with one end of the bow string structure. Stressing means are also provided which are operable in response to the imposition of pulling force on the bow string structure to stress the first and other elongate energy storing means in multiple zones, extending longitudinally of the limb means, and thereby store energy in multiple zones along the limb structure. The stressing means is also operable, in response to the release of said bow string structure, to release the energy stored in multiple zones by the first and other elongate energy storing means. During this release, energy stored in the first and other elongate energy storing means is transmitted longitudinally of the limb structure through one of the first and other elongate energy storing means, transversely of the longitudinal directions of the first and other energy storing means and through the energy transfer means to the other of the first and other elongate energy storing means and through the energy transfer means to the other of the first and other elongate energy storing means, longitudinally of the other of the first and other elongate energy storing mens, and through the force transmitting connecting means to the bow string structure.

The release of energy through the first and other elongate energy storing means is effected in directions extending generaly longitudinally of the limb means. The release of energy from the first and other elongate energy storing means is further effected remote from said nocking zone and remote from an area between the nocking zone and the hand grip means. Moreover, the first and other energy storing means cooperate with the bow string means to provide a substantially unobstructed area between the bow string structure and the hand grip structure.

The invention may further embrace such an archery apparatus wherein, in response to said pulling of said bow string means, energy is stored in each of the first and second elongate energy storing means in response to elongate distension of each of the first and second elongate energy storing means not exceeding about five percent of the length thereof.

The invention also contemplates an apparatus including an eccentric system having a member pivotally and eccentrically supported on the limb and hand grip assembly and operable to pivot about an axis extending generally transversely of the pull direction of the bow string structure. This eccentric member may comprise a cam means. A pivot means pivotably mounts the eccentric member, is spaced from the pivot means and disposes the eccentric member and the bow string structure in force transmitting communication. A second securing means, carried by the eccentric member, is spaced from the pivot means and dispose the eccentric member in force transmitting communicaton with the anchor means. A first follower means is connected in force transmitting communication with the bow string structure to translate along a first periphery porton of the eccentric member in response to pulling of the bow string structure, with this first periphery portion defining first lever arm means upon which force is exerted by the bow string structure. A second follower means is also provided which is connected in force transmitting communication with the energy storing assembly and is operable to translate along a second periphery portion of the eccentric member in response to pulling of the bow string structure. This second periphery portion defines second lever arm means upon which force is exerted by the energy storing assembly in a direction extending longitudinally of the limb means.

Other independently significant aspects of the invention relate to particular mounting and location arrangements for the eccentric member and energy transfer means, particular energy storing arrangements, and to bows wherein each of the bow limb structures has an eccentric system and a multi-directional energy storing and release system associated therewith and where means may be provided to coordinate the movements of the eccentric members associated with each limb structure.

DRAWINGS

By way of example, but without limitation, the invention will now be described with respect to preferred embodiments illustrated in the appended drawings.

Figure 7:
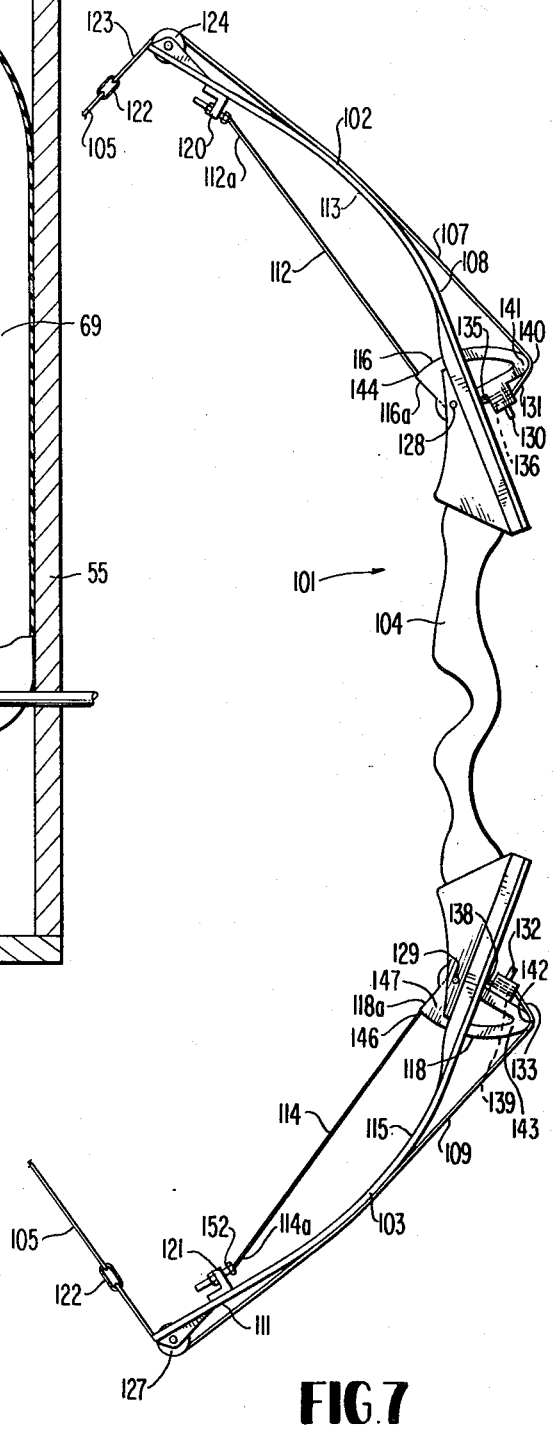
Figure 8:
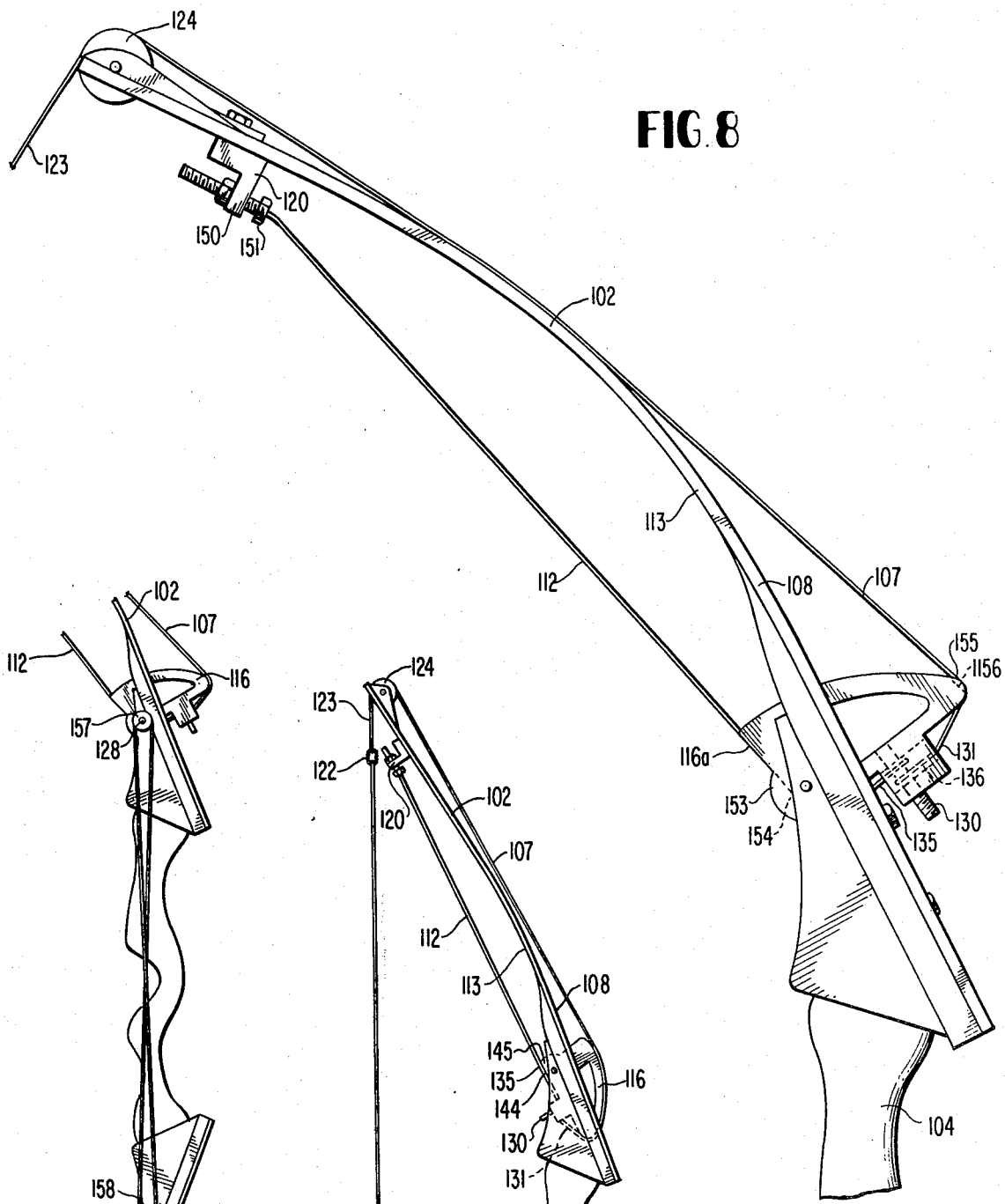
Figure 10:
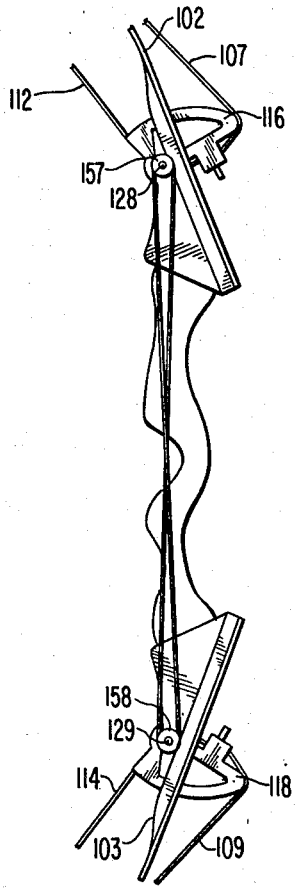
Figure 9:
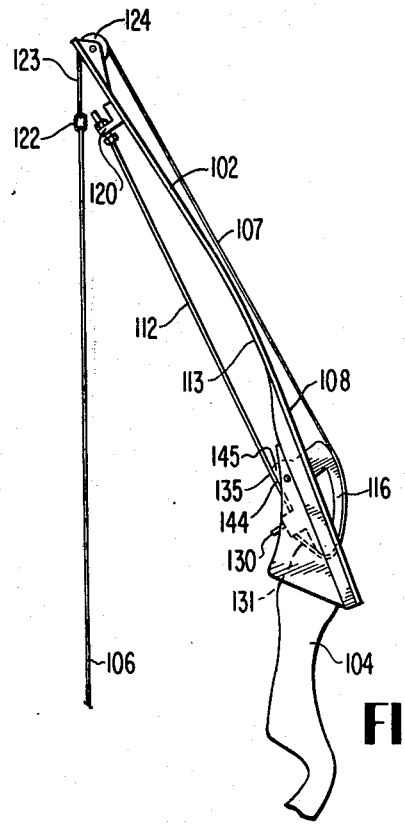

In the drawings:

FIG. 1 provides a schematic illustration of the counteracting bidirectional energy storing and release system of the present invention;

FIGS. 2–5 provides illustrations of a "tensile band" mode of the invetion;

FIG. 2 provides a side elevational view of the "tensile band" mode of the invention;

FIG. 3 provides an enlarged, fragmentary, side elevational view of a limb extremity of the FIGS. 2–5 apparatus;

FIG. 4 provides an enlarged fragmentary view of a force transmitting porton of the FIGS. 2–5 apparatus, located in the immediate vicinity of bow hand grip means;

FIG. 5 provides a transverse sectional view of the cam-lever mechanism shown in FIG. 3;

FIG. 6 provides a schematic representation of a unique, pneumatic bladder forming arrangement operable to form the "tensile band" means employed in the FIGS. 2–5 apparatus;

FIGS. 7–9 provide views of an alternative "buckling beam" mode of the invention;

FIG. 8 provides an enlarged, side elevational view of one limb of the FIGS. 7–9 bow, illustrating this limb in a "buckled" condition;

FIG. 9 provides a reduced scale view of the FIG. 8 limb, showing this limb in a relaxed, straightened, or "non-buckled" condition; and FIG. 10 illustrates a pulley arrangement which may be employed to interconnect the cam-lever means of the FIG. 7 bow so as to tend to more positively ensure complete uniformity of operation of cam-lever means individually associated with each of the two "buckling beam" limbs of this form of the apparatus.

GENERAL DESCRIPTION OF THE INVENTION

In describing the invention, reference will be first made to a schematic illustration shown in FIG. 1.

FIG. 1, in a schematic sense, depicts a bow having a upper limb A, a lower limb B, a hand grip C, and a bow string D.

Associated with upper limb A are elongate energy storing means M and N. Energy storing means M and N are disposed, respectively, on opposite sides of the limb A and extend generally longitudinally thereof.

Similary, limb B has associated with it elongate energy storing means O and P. These energy storing means O and P are arranged to extend generally longitudinally of and be disposed on opposite sides of the limb B.

When bow string D is distended or pulled, energy is stored in the elongate energy storing means M, N, O and P, with the energy being stored in means M and N in resonse to generally oppositely directed forces and with energy being stored in means O and P in response to generally oppositely directed forces.

Energy storing means M and N are interconnected in sequential, force transmitting relationship and are connected with the upper end of the bow string B. Similarly, energy storing means O and P are interconnected and are disposed in sequential force transmitting communication with the lower end of bow string D.

When bow string D is released, energy stored in means M and N is generally released in the directions indicated by the arrows associated with limb A so as to be released in mutually opposite directions on opposite elongate sides of the limb A, transmitted transversely of limb A, and released to the bow string D.

Similarly, energy stored in energy storing means O and P is released in the general sequence of arrows shown in association with limb B so as to be released in mutually oppositely directed directions on opposite elongate sides of the limb B, transmitted transversely of limb B, and released to bow string D.

Energy storing and releasing means M, N, O and P are generally characterized by relatively low distension in relation to amounts of energy stored. This factor, coupled with the oppositely directed release of energy on opposite sides of each bow limb, is believed to contribute to particularly effective bow performance, with minimization of recoil and reaction forces.

Having described basic overall characteristics of the present invention, reference will now be made to two different embodiments operable to achieve basic objectives of the invention.

The first embodiment relating to FIGS. 2–5 is characterized by relatively rigid bow limbs, with energy being stored through distension of the energy storing means associated with each of the bow limbs. This embodiment will be referred to as the "tensile band" mode of the invention.

In the embodiment set forth in FIGS. 7–9, the bow limbs are flexible and contribute themselves to the distension involved in energy storing. However, here again a relatively low degree of distension of energy storing components is involved. This embodiment will be referred to as the "buckling beam" mode of the invention.

With the basic aspects of the invention and basic distinguishing characteristics to two embodiments having been set forth, it now becomes appropriate to consider in detail structural details of each of the "tensile band" and "buckling beam"of the invention.

TENSILE BAND EMBODIMENT

In describing the "tensile band" embodiment of the invention, reference will be made to basic components, which may be summarized as to their elemental constituents as follows:

| Component | FIGS. 2–5 (tensile band) Embodiment |
|---|---|
| bow | bow 1 |
| first limb means | upper rigid limb 2 |
| second limb means | lower rigid limb 3 |
| hand grip means interconnecting first and second limb means | hand grip 4 |
| bow string means extending between first and second limb means | bow string 5 |
| nocking zone of bow string means operable to engage arrow | string nocking zone 6 |
| first elongate energy storing means extending longitudinally along one side of at least one limb means | energy storing fiber glass band means 7 on outer side 8 of limb 2; energy storing fiber glass band means 9 on outer side 11 of limb 3 |
| second elongate energy storing means extending longitudinally along another side of limb means | energy storing fiber glass band means 12 on inner side 13 of limb 2; energy storing fiber glass band means 14 on inner side 15 of limb 3 |
| energy transfer means extending transversely of and across the longitudinal axes of the first and second elongate energy storing means and operable to interconnect first and second elongate energy storing means | sheave 16 on inner end of limb 2 and band portion 17 connecting and integral with bands 12 and 7; sheave 18 on inner end of limb 3 and band portion 19 connecting and integral with bands 14 and 9 |
| anchor means connecting one end of interconnected first and second elongate energy storing means with at least one of the limb means | anchor 20 connecting with band 12 and fixed to side 13 of limb 2; anchor 21 connected with band 14 and fixed to side 15 of limb 3 |
| force transmitting connecting means connecting a second end of the interconnected first and second elongate energy storing means with one end of the bow string means | bracket 22 connected with band 12 and slideable on side 8 of limb 2 and connected via flexible spring steel strap 23 and pivoted cam-lever means 24 with upper end of string 5; bracket 25 connected with band 14 and slideable on side 11 of limb 3 and connected via flexible spring steel strap 26 and pivoted cam-lever means 27 with lower end of string 5 |
| cam-lever means | cam-lever 24 pivoted on upper end of limb 2; cam-lever 27 pivoted on lower end of limb 3 |
| pivot means detachably and pivotably mounting cam means on one of limb means | pivot shaft 28 pivotably mounting cam-lever 24 on limb 2; pivot shaft 29 pivotably mounting cam-lever 27 on limb 3 |
| first securing means carried by cam means and fixedly connecting cam means and bow string means in force transmitting communication | pin 30 on cam-lever 24 connected with eyelet end 31 of string 5; pin 32 on cam-lever 27 connected with eyelet end 33 of string 5 |
| second securing means carried by cam means and fixedly connecting cam means in force transmitting communication with the anchor means by way of the first and second elongate energy storing means | pin 34 securing loop portion 35 of band 23 in wedge-shaped recess 36 of cam-lever 24; pin 37 securing loop portion 38 of band 26 in wedge-shaped recess 39 of cam-lever 27 |
| first cam follower means | portion 40 of string 5 riding on periphery portion 41 of cam-lever 24; portion 42 of string 5 riding on periphery portion 43 of cam-lever 27 |
| second cam follower means | portion 44 of band 23 riding on periphery portion 45 of cam-lever 24; portion 46 of band 26 riding on periphery portion 47 of cam-lever 27 |

An improvement of the "tensile band" embodiment resides in a counteracting, bidirectional energy storing and release system including first elongate energy storing means 7 and 9, extending longitudinally along the outer sides 8 and 11 of the limb means 2 and 3 and second elongate energy storing means 12 and 14 extending longitudinally along inner sides 13 and 15 of the limb means 2 and 3. The energy transfer means 16–17 and 18–19 extend transversely of and across the longitudinal axis of the elongate energy storing means 7–12 and 9–14, respectively. The energy transfer means are operable to interconnect the elongate energy storing means 7 and 12 as well as 9 and 14 in force transmitting communication.

The anchor means 20 and 21 connect first ends **12*a* and 14*a* of the interconnected elongate energy storing means 7–12 and 9–14 with the limb means 2 and 3, respectively. The force transmitting, connecting means 22, 23, 24 and 25, 26, 27 connect second ends 7*a* and 9*a* of the interconnected elongate energy storing means 7–12 and 9–14 with one end of the bow string means 5**.

The arrangement heretofore described affords stressing means which are operable in response to the imposition of pulling force on the bow string means 5 to stress the elongate energy storing means 7 and 12 as well as 9 and 14 in generally mutually opposite directions, extending longitudinally of the limb means 2 and 3, and thereby store energy on opposite sides of the limb means. The system is also operable, in response to the release of the bow string means 5, to release the energy stored on opposite sides of the limb means in the elongate energy storing means.

During this release, energy stored in the interconnected elongate energy storing means 7–12 and 9–14 is transmitted longitudinally of sides 13 and 15 of their associated limb means 2 and 3 through the elongate energy storing meas 12 and 14, transversely of the limb means 2 and 3 through the energy transfer means to the other of the elongate energy storing means (i.e., means 7 and 9, respectively), longitudinally of the other sides 8 and 11 of the limb means 2 and 3 through the other of the elongate energy storing means (i.e., means 7 and 9), and through the force transmitting connecting means to the bow string means.

The release of energy through the elongate energy storing means 7 and 12 as well as 9 and 14 is effected in generally mutually opposite directions, extending generally longitudinally of the limb means 2 and 3 and in close proximity to opposite sides thereof. The release of energy from the elongate energy storing means 7 and 12 as well as 9 and 14 is further effected remote from the nocking zone 6 and remote from the area between the nocking zone 6 and the hand grip means 4 and remote from an area extending linearly between the tips of the first and second limbs 2 and 3. Moreover, the energy storing means cooperate with the bow string means to provide a substantially unobstructed area between the bow string means 5 and the hand grip means 4.

The ends 7*a*, 12*a*, 9*a* and 14*a* of the elongate energy storing means connected with the brackets 22 and 25 and with the anchor means 20 and 21 preferably comprise diverging energy storing paths extending from intermediate portions of the ends of the interconnected elongate energy storing means toward brackets and the anchor means, respectively.

The cam-lever system of this embodiment of the invention includes cam-lever means 24 and 27 pivotably supported on the limb means 2 and 3 and operable to pivot about axes extending generaly transversely of the pull direction of the bow string means.

Pivot means 28 and 29 may both detachably and pivotably mount the cam-lever means 24 and 27 on the limb means 2 and 3. First securing means 30 and 32, carried by the cam-lever means 24 and 27, are spaced from the pivot means 28 and 29 and fixedly connect the cam-lever means 24 and 27 and the bow string means 5 in force transmitting communication. The second securing means 34, 35, 36 and 37, 38, 39, carried by the cam-lever means 24 and 27, are spaced from the pivot means 28 and 28 and fixedly connect the cam-lever means 24 and 27 in force transmitting communication with the anchor means 20 and 21 through, or by way of, the elongate energy storing means.

The first cam follower means comprising string portions 40 and 42 are connected with the nocking zone 6 and are operable to translate along first periphery portions 41 and 43 of the cam-lever means 24 and 27 in response to pulling of the bow string 5. These first periphery portions 41 and 43 define, in effect, first lever arm means of the cam-lever means 24 and 27 upon which force is exerted by the bow string 5.

The second cam follower means, which comprise band portions 44 and 46, are connected with the elongate energy storing means and are operable to translate along second periphery portions 45 and 47 of the cam-lever means 24 and 27 in response to pulling of the bow string 5. These second periphery portions define, in effect, second lever arm means of the cam-lever means 24 and 27 upon which force is exerted by the energy storing means in directions extending longitudinally of the limb means 2 and 3. In this embodiment, the elongate energy storing means 7 and 12 as well as 9 and 14 are operable to store generally uniformly distributed and substantially similar levels of energy in response to pulling of the bow string 5.

While the structural interrelationships of the various components of the FIGS. 2–5 bow are believed to be clearly set forth in light of the preceding discussion and the drawings, certain additionl comments may be in order.

Each of the sheave means 16 and 18 may be mounted so as to be selectively adjustable longitudinally of their respectively associated limbs.

Thus, as is shown in FIG. 4, the sheave 16 is slideably mounted on limb 2 by way of a conventional, threaded, position adjusting mechanism 50.

This mechanism 50 includes elongate slot means 51 within which a shaft 52 supporting sheave 16 is longitudinally slideably disposed. Shaft 52 is engaged on opposite ends by threaded, adjusting rod means 53.

By selectively manipulating the rod means 53, the position of the sheave 16 may be adjusted longitudinally of the limb 2 so as to selectively adjust the tension in the tension band fiber glass strip means 7 and 12.

A similar, threaded, band tension adjusting means 54 is associated with the sheave 18.

As will be recognized at this juncture, the adjusting of the tension in fiber glass band 7 and 12, by appropriate manipulation of adjusting mechanisms 50 and 54, will also serve to determine the "art rest" or relaxed position of the cam-lever means 24 and 27. This will determine the relative lengths of the lever arm means provided by peripheral portions of the cam-lever means 24 and 27 acting in cooperation with the bow string 5 and the energy storing system so as to determine the amount of energy able to be stored in the bow string in response to the pulling force exerted on the string itself and the requisite pulling force.

Thus, by way of example, it is contemplated that with cam-levers configured generaly as shown in FIGS. 2–3, a pull exerted on the bow string on the order of about 30 pounds will be sufficient to produce about 70 pounds of stored force in the bow string available to act upon the arrow when the bow string is released.

In connection with each of the cam-lever means 24 and 27, their respectively associated pivot mounting means 28 and 29 may be removably mounted on the bow limbs so as to permit of selective replacement of either or both of the cam-lever means 24 and 27. This enables the cam-lever means 24 and 27 to be configured in accordance with paticular bow characteristics requirements.

As will be appreciated, by changing the peripheral configuration of portions 41 and 43 of the cam-lever means 24 and 27, the effective length of the lever arm means of the cam-lever means 24 and 27 acting in cooperation with the bow string 5 will be of the desired dimension at any particular point in the pulling cycle.

Similarly, by appropriately configuring the portion 45 of cam 24 and the portion 47 of cam 27, the effective length of the lever arm means of the cam-levers 24 and 27 associated and coating with the energy storing system will assume the desired effective length at any point in the pulling cycle.

As will be further recognized, each of the cam-lever means 24 and 27 may be provided with appropriate openings such as the openings 24*a* and 27*a* so as to provide a reduction in weight of these cam-lever means and thus reduce the overall bow weight.

By reference to FIGS. 2 and 3 it will be further apparent that the cam-lever means 24 and 27 are configured so as to provide effective indications of the attainment of maximum or optimum pulling force.

Thus, when optimum pulling force is achieved, the cam surface 24*b* of cam 24 will be brought into abutting indication with strap 23 so as to indicate to the user that a desired maximum pulling lever has been achieved, i.e., and thereby provide a "stop pull" indication. The same is true, of course, of cam 27. Sufficient rotation of the cam 27 induced by pulling of the string 5 will bring the cam surface 27*b* into abutting cooperation with the strap 26 at the point in time when cam surface 24*b* engages the strap 23.

TENSILE BAND AND ITS MODE OF FABRICATION

While a variety of structural materials may be employed in fabricating the band components of the energy storing system, it is contemplated that a fiber glass band or tape may be effectively employed. Type E (electrical grade) or type S (structural grade) fiber glass tape may be effectively employed, having a width on the order of about one-half inch.

Where fiber glass bands are employed, it is believed that acceptable amounts of energy may be stored in a bow of the type depicted in FIGS. 2–5 where the band means 7-17-12 and 9-19-14 are distended or stretched only on the order of about 2 percent of the total band length.

In any event, it is contemplated that adequate energy storage may be effected by elongation of the band means not exceeding about five percent.

For optimum results it is contemplated that where a fiber-type energy storing band system is employed, the fiber should preferably be arranged in a unidirectional maner, extending longitudinally of their respectively associated bow limbs.

Obviously, materials other than fiber glass might be employed, i.e., other fibrous materials such as nylon, etc., or carbon filaments, or other "low distortion" energy storing materials may be employed. or other "low distortion" energy storing materials may be employed.

While the tensile band means employed in the FIGS. 2–5 embodiment may be fabricated in a variety of ways, one technique for fabricating the energy storing system associated with each of the bow limbs is shown schematically in FIG. 6.

As shown in FIG. 6, the tensile band fabricating apparatus 55 is characterized by a central forming platen 56 upon which a strip 57 of fiber glass tape is supported so as to form a closed loop, the ends of which may be located at end juncture 58. The diverging ends 59 and 60 of each extremity of the tensile band (designed to engage, for example, bracket 22 and anchor 20 or bracket 25 and anchor 21) are formed by inserting appropriate wedge-shaped form means 61 and 62 into band end forming positions as generally shown in FIG. 6, within the interior of the diverging tensile band ends 59 and 60.

The wedge form 61 may be secured by removable pin connecting means 63 to a bracket 67 which is slideably mounted on core 56. The position of bracket 64 may be adjusted by threaded fastening means 65.

Similarly, forming wedge 62 may be connected by removable pin means 66 to a bracket 67. Bracket 67 may be slideably mounted on forming core 56, with its position relative to the core being adjusted as desired by threaded adjusting and fastening means 68.

With the band apropriately positioned as shown in FIG. 6 and epoxy resin applied to the sandwiched or contiguous portions of the band 57 extending between the diverging end portions 59 and 60, and with the position of brackets 64 and 67 being appropriately adjusted so as to take the slack out of the band 57, a U-shaped forming bladder 69 may be inflated. Forming bladder 69, when inflated, will press the contiguous tape portions into pressure bonding face-to-face contact as curing of the epoxy resin takes place.

When the epoxy resin has cured, the bladder 69 may be deflated, the wedges 61 and 62 removed by detaching the separable fastening pins 63 and 66, and the completed tensile band intended for association with one bow limb removed.

This procedure, of course, would be repeated in connection with the forming of the tensile band means associated with each of the bow limbs.

BUCKLING BEAM EMBODIMENT

In describing the "buckling beam" embodiment of the invention, reference will be made to basic components, which may be summarized as to their elemental constituents as follows:

| Component | FIGS. 7–9 (buckling beam) Embodiment |
|---|---|
| bow | bow 101 |
| first limb means | upper flexible limb 102 |
| second limb means | lower flexible limb 103 |
| hand grip means interconnecting first and second limb means | hand grip 104 |
| bow string means extending between first and second limb means | bow string 105 |
| nocking zone of bow string means operable to engage arrow | string nocking zone 106 |
| first elongate energy storing means extending longitudinally along one side of at least one limb means | energy storing, steel cable extension 107 of bow string 105 on outer side 108 of flexible limb 102; energy storing, steel cable extension 109 of bow string 105 on outer side 111 of flexible limb 103 |
| second elongate energy storing means extending longitudinally along another side of limb means | energy storing, steel cable extension 112 of bow string 105 on inner side 113 of flexible limb 102; energy storing, |

-continued

| Component | FIGS. 7–9 (buckling beam) Embodiment |
|---|---|
| | steel cable extension 114 on inner side 115 of flexible limb 103 |
| energy transfer means extending transversely of and across the longitudinal axes of the first and second elongate energy storing means and operable to interconnect first and second elongate energy storing means | cam-lever 116 on inner end of limb 102; cam-lever 118 on inner end of limb 103 |
| anchor means connecting one end of interconnected first and second elongate energy storing means with at least one of the limb means | anchor 120 connected with cable 112 and fixed to side 113 of limb 102; anchor 121 connected with cable 114 and fixed to side 115 of limb 103 |
| force transmitting connecting means connecting a second end of the interconnected first and second elongate energy storing means with one end of the bow string means | fitting 122 connecting end 123 of cable 107 with bow string 105 and passing around sheave 124 at end of limb 102; fitting 125 connecting end 126 of cable 109 with bow string 105 and passing around sheave 127 at end of limb 103 |
| cam-lever means | cam-lever 116 pivoted on lower end of limb 102; cam-lever 118 pivoted on upper end of limb 103 |
| pivot means detachably and pivotably mounting cam means on one of limb means | pivot shaft 128 pivotably mounting cam-lever 116 on limb 102; pivot shaft 129 pivotably mounting cam-lever 118 on limb 103 |
| first securing means carried by cam means and fixedly connecting cam means and bow string means in force transmitting communication | pin 130 on cam-lever 116 connected with eyelet end 131 of bow string extension, i.e., cable 107; pin 132 on cam-lever 118 connected with eyelet end 133 of bow string extension, i.e., cable 109 |
| second securing means carried by cam means and fixedly connecting cam means in force transmitting communication with the anchor means by way of the first and second elongate energy storing means | pin 130 securing eyelet portion 135 of cable 112 in recess 136 of cam-lever 116; pin 132 securing eyelet portion 138 of cable 114 in recess 139 of cam-lever 118 |
| first cam follower means | portion 140 of cable 107 riding on periphery portion 141 of cam-lever 116; portion 142 of cable 109 riding on periphery portion 143 of cam-lever 118 |
| second cam follower means | portion 144 of cable 112 riding on periphery portion 145 of cam-lever 116; portion 146 of cable 114 riding on periphery portion 147 of cam-lever 118 |

A basic improvement of this "buckling beam" embodiment of the invention comprises a counteracting, bidirectional energy storing and release system including first elongate energy storing means 107 and 109, extending longitudinally along sides 108 and 111 of the limb means 102 and 103 and second elongate energy storing means 112 and 114 extending longitudinally along other sides 113 and 115 of limb means 102 and 103. The energy transfer means 116 and 118 extend transversely of and across the longitudinal axis of their respectively associated first and second elongate energy storing means. The energy transfer means 116 and 118 are operable to interconnect the first and second elongate energy storing means 107 and 112 as well as 109 and 114 in force transmitting communication.

The anchor means 120 and 121 connected first ends 112*a* and 114*a* of the interconnected first and second elongate energy storing means with the limb means 102 and 103. The force transmitting, connecting means 122 and 125 connect second ends 123 and 126 of the interconnected first and second elongate energy storing means with ends of the bow string means 105.

The system as described affords stressing means operable in response to the imposition of pulling force on the bow string means 105 to stress each first and second elongate energy storing means in generally mutually opposite directions, extending longitudinally of their associated limb means, and thereby store energy on opposite sides of such limb means.

The system is also operable, in response to the release of the bow string means 105, to release the energy stored on opposite sides of each limb means in its associated first and second elongate energy storing means. Thus, during this release, energy stored in the first and second elongate energy storing means is transmitted longitudinally of sides 113 and 115 of the limb means 102 and 103 through the elongate energy storing means 112 and 114, transversely of the limb means 102 and 103 through the energy transfer means 116 and 118 to the other of the first and second elongate energy storing means (i.e., means 107 and 109), longitudinally of the other sides 108 and 111 of the limb means 102 and 103 through the other of the first and second elongate energy storing means (i.e., means 107 and 109), and through the force transmitting connecting means 122 and 125 (for possibly an integral cablebow string means) to the bow string means 105.

The release of energy through each interconnected first and second elongate energy storing means is effected in generally mutually opposite directions, extending generally longitudinally of their associated limb means and in close proximity to opposite sides thereof. The release of energy from each first and second elongate energy storing means is further effected remote from the nocking zone 106 and remote from an area between the nocking zone 106 and the hand grip means 104 and remote from an area extending linearly between the tips of the first and second limbs 102 and 103. Moreover, each first and second energy storing means cooperates with the bow string means 105 to provide a substantially unobstructed area between the bow string means 105 and the hand grip means 104.

In this form of the invention, the cam-lever system has cam-lever means 116 and 118 pivotably supported on the limb means 102 and 103 and operable to pivot about axes extending generally transversely of the pull direction of the bow string means 105. The pivot means 128 and 129 detachably and pivotably mount the cam-lever means 116 and 118 on the limb means 102 and 103.

The first securing means 130, 131 and 132, 133, carried by the cam-lever means 116 and 118, are spaced from the pivot means 128 and 129 and fixedly connect the cam-lever means 116 and 118 and the bow string means 105 in force transmitting communication. The second securing means 130, 135 and 132, 138, carried by the cam-lever means 116 and 118, are spaced from the pivot means 128 and 129 and fixedly connect the cam-lever means 116 and 118 in force transmitting communication with the anchor means 120 and 121 through, or by way of, the elongate energy storing means.

The first cam follower means, comprising cable portions 140 and 142, are connected with the nocking zone 106 and operable to translate along first periphery portions 141 and 143 of the cam-lever means 116 and 118 in response to pulling of the bow string 105. The first periphery portions 141 and 143 define, in effect, first lever arm means of the cam-lever means 116 and 118 upon which force is exerted by the bow string 105.

The second cam follower means, comprising cable portions 144 and 146, are connected with the elongate energy storing means and are operable to translate along second periphery portions 145 and 147 of the cam-lever means 116 and 118 in response to pulling of the bow string 105. These second periphery portions 145 and 147, in effect, define second lever arm means of the cam-lever means 116 and 118 upon which force is exerted by the elongate energy storing means in directions extending longitudinally of the limb means 102 and 103.

In this embodiment, the first and second elongate energy storing means 107, 112 and 109, 114 are operable, in response to pulling of said bow string 105, to flex the limb means 102 and 103 and effect a transmittal of energy between the flexed limb means and the first and second elongate energy storing means. Thus, as shown in FIG. 8 in connection with limb 102, the flexing of the bow string 105 will create tension in cable means 107 and 112 so as to cause a buckling or flexing of the limb 102. This buckling or flexing of the limb 102 will provide an energy storage reservoir, tending to maintain the energy storing cable means 107 and 112 in tension, i.e., as intermediate reservoirs of energy available for transmittal to the bow string.

As will also be appreciated, the first elongate energy storing means 107 and 109 and the second elongate energy storing means 112 and 114 are operable to store substantially different levels of energy, albeit generally uniformly distributed in each energy storing means, in response to pulling of said bow string. These different levels of energy result from the forces in string 105 and cables 107 and 109 balancing the forces in cables 112 and 114.

As will be apparent by reference to FIGS. 7–9, steel cable means 112 and 107 comprise interconnected energy storing means extending longitudinally along each side of the bow limb 102. Similarly, the steel cable means 114 and 109 comprise interconnected steel cable means providing energy storing means extending longitudinally along opposite sides of the bow limb 103.

Energy storing means 107 and 112 are interconnected by pin means 130, with eyelet ends 131 and 136 of steel cable means 107 and 112 passing respectively through cam-lever opening or recess means 136 and being intersected by threaded fastening pin means 130.

The same arrangement exists in connection with cable means 109 and 114, with cable eyelet portions 133 and 138 passing respectively through recess 139 of cam-lever 118 and being intersected by threaded and selectively positionable fastening pin means 132.

The desired tension levels in the energy storing system and the initial positions of the cam-lever means 116 and 118 may be determined by threaded adjusting means. Thus, a threaded adjusting means 150 is associated with the anchor 120 and comprises a selectively positionable threaded rod 151 connected with the upper end 112*a* of steel cable 112. By adjusting the position of threaded adjusting rod 151, the tension in cable means 112-107 may be controlled as desired and the initial or relaxed position of the cam-lever means 116 appropriately determined so as to determine bow characteristics.

A similar threaded adjusting mechanism 152 is associated with the anchor means 121. Adjusting means 152 will serve to determine appropriate tension conditions in cable means 114 and 109 and the initial operating position of the cam-lever means 118, and thus determine bow characteristics.

The FIGS. 7–9 embodiment also includes a "pull stop" feature. The limits of bow "pulling" are indicated when cam surfaces 116*a* and 118*a* engage cables 112 and 114 respectively, as shown in FIGS. 7 and 8.

Each of cam-lever means 116 and 118 may be selectively removable and replaceable by making pivot mounting means 128 and 129 selectively removable. In this manner, appropriate cam-lever configurations can be provided in accordance with individual archer requirements.

In order to provide appropriate guidance for the cable means, each of the cam-lever means 116 and 118 may be provided with cable constraining and slot defining wall means.

Thus, for example, as shown in connection with cam-lever 116 in FIG. 8, wall means 153 may provide slot 154 which constrainingly receives the cable 112 as it passes around the surface 145 enroute to the pin 130. Similarly, constraining walls 155 may provide a cable receiving slot 156 operable to receive the cable 107 as it passes around the surface 141 enroute to the connecting pin 130. These same arrangements may exist in relation to cam-lever 118.

MODIFICATIONS AND PULL CHARACTERISTICS

In connection with either of the embodiments, it may be desirable in certain instances to provide particularly positive assurance of coordinated movement of the cam-lever means, i.e. eccentric members Thus, as shown in FIG. 10 in connection with the FIGS, 7–9 embodiment, the cam-levers 116 and 118 may be provided with movement coordinating pulley means, i.e. sheaves 157 and 158. Pulley means 157 is made rigid with cam-lever 116 but is journalled for pivotal movement about pivot connecting means 128.

Similarly, pulley 128 is rigid with the cam-lever 118 but is pivotable about the pivot mounting 129.

A "crossed over" pulley line 159, arranged generally as shown in FIG. 10, extends about the pulleys 157 and 158 and frictionally engages the periphery of these pulleys so as to ensure coordinated and oppositely directed pivotal movements of the cam-lever means 116 and 118.

While the extent of "pull" of the bow string may vary depending upon particular user requirements, it will be noted that in each of the embodiments heretofore described, the storing of energy in the energy storing means of the system tends to effect a reduction in the distance between the effective tips of the bow limbs.

Thus, in connection with the FIGS. 2–5 embodiment, rotation of the cam-lever means to the point where the surfaces **24*b* and 27*b* are moved into engagement with the bands 23 and 26** will rotate the cam extremities so as to in essence reduce the linear distance between the outer extremities of the cams which, of course, define the effective tips of the bow limbs. This phenomenon will contribute to available "pull" in the bow string, along with the distension of the energy storing bands.

In the FIGS. 7–9 embodiment, the "buckling" of the limbs 102 and 103 will produce a shortening of the distance between the tips of the bow limbs. This shortening, coupled with the effective lengthening of the cable ends 123 and 126 of the steel cable energy storing means, will cooperate to provide desired "pull" characteristics.

Needless to say, either the coaction between available "pull" as afforded by distension or effective lengthening of the energy storing means and available "pull" as afforded by shortening the distance between bow limb tips or such distension and or lengthening or shortening individually, may be tailored as desired to individual requirements.

SUMMARY OF MAJOR ADVANTAGES AND OVERALL SCOPE OF INVENTION

In describing the invention, its structural and operational characteristics, along with its principal advantages, have been made apparent.

This description has also reflected the manner in which the concept of this invention departs markedly, both in concept and mode of operation, from the teachings of prior art such as the Allen U.S. Pat. No. 3,486,495 and other prior art exemplified by patents such as Mulkey U.S. Pat. No. 2,714,377, Hamm U.S. Pat. No. 3,518,980, Cordrey et al U.S. Pat. No. 2,307,021.

A principal advantage of the invention resides in the technique where the energy storing system is characterized by multi-directional energy releasing characteristics and energy storing characteristics.

Energy is stored in multiple zones, longitudinally of bow limb structures so as to avoid obstruction of the nocking zone of the bow string and maintain a single string or line extending between bow limb tips.

In describing the invention as characterized by some or all of these advantages, those skilled in the art will have been provided with guidance for further modifications consistent with the present teaching.

Thus, those skilled in the archer art and familiar with the disclosure of this invention may well recognize additions, deletions, substitutions, or other modifications which would fall within the scope of the invention as set forth in the appended claims.

What is claimed is:

1. In an archery apparatus comprising:

a limb and hand grip assembly including
- a first limb structure,
- a second limb structure, and
- a hand grip structure,
- said hand grip structure interconnecting said first and second limb structures,
- with said first and second limb structures extending generally oppositely away from said hand grip structure, and energy storing and releasing means operable to store and release energy and including
- a bow string structure extending between said first and second limb structures, and
- said bow string structure providing a mocking zone operable to engage an arrow;

the improvement wherein said energy storing and releasing means comprises a multi-directional energy storing system including first elongate energy storing means for storing energy extending longitudinally along at least one of said limb structures; and other elongate energy storing means for storing energy extending longitudinally aong said at least one of said limb structures;

energy transfer means for transferring energy transversely of the longitudinal directions of said first and other elongate energy storing mens;

said energy transfer means being operably connected to said first and other elongate energy storing meant to interconnect said first and other elongate energy storing means in force transmitting communicaton;

anchor means connecting a first end of said interconnected first and other elongate energy storing means with said limb and hand grip assembly;

force transmitting connecting means connecting a second end of said interconnected first and other elongate energy storing means with one end of said bow string structure;

stressing means operable in response to the imposition of pulling force on said bow string structure to stress said first and other elongate energy storing means, in said directions extending longitudinally of said at least one of said limb structures and thereby store energy in multiple zones extending generally longitudinally of said at least one of said limb structures, said multiple zones comprising a plurality of zones, at least one of which includes said first elongate energy storing means and at least another of which includes said other elongate energy storing means;

said stressing means being operable in response to the release of said bow string structure to release said energy stored in said multiple zones by said first and other elongate energy storing means with energy stored in said first and other elongate energy storing means being transmitted
- longitudinally of said at least one of said limb structures through one of said first and other elongate energy storing means,
- transversely of said longitudinal directions through said energy transfer means to the other of said first and other elongate energy storing means, longitudinally of said at least one of said limb structures through the other of said first and other elongate energy storing means, and through said force transmitting connecting means to said bow string structure, said release of energy through said first and other elongate energy storing means being effected in directions extending generally longitudinally of said at least one of said limb structures, and said release of energy from said first and other elongate energy storing means being effected remote from said nocking zone and remote from an area between said nocking zone and said hand grip structure;

said first and other energy storing means cooperating with said bow string structure to provide a substantially unobstructed area between said bow string structure and said hand grip structure.

2. An archery apparatus as described in claim 1 wherein each of said first and second structures includes a said multi-directional energy storing system associated therewith.

3. An archery apparatus as described in claim 2 wherein:

in response to said pulling of said bow string structure, energy is stored in each of said first and other elongate energy storing means in resonse to elongate distension of each of said first and other elongate energy storing means not exceeding about 5 percent of the length thereof.

4. An apparatus as described in claim 2 wherein said apparatus includes an eccentric system having an eccentric member pivotally supported on said limb and hand grip assembly and operable to pivot about an axis extending generally transversely of the pull direction of said bow string structure;

pivot means pivotably and eccentrically mounting said eccentric member on said limb and hand grip assembly;

first securing means carried by said eccentric member, spaced from said pivot means, and disposing said eccentric member and said bow string structure in force transmitting communication;

second securing means carried by said eccentric member, spaced from said pivot means and disposing said eccentric member and said anchor means in force transmitting communication;

first follower means connected in force transmitting communication with said bow string structure to translate along a first periphery portion of said eccentric member in response to pulling of said bow string structure, with said first periphery portion defining first lever arm means of said eccentric member upon which force is exerted by said bow string structure; and second follower means connected in force transmitting communication with said energy storing assembly to translate along a second periphery portion of said eccentric member in response to pulling of said bow string structure, with said second periphery portion defining second lever arm means of said eccentric member upon which force is exerted by said energy storing assembly in a direction extending generally longitudinally of said at least one of said limb structures.

5. An archery apparatus as described in claim 4 wherein each of said first and second limb structures includes a said eccentric system associated therewith.

6. An archery apparatus as described in claim 5 wherein:

said eccentric member is pivotally mounted by said pivot means at an inner end of said at least one of said limb structures generally adjacent said hand grip structure;

said energy transfer means comprises said eccentric member; and said first and other elongate energy storing means are operable, in response to pulling of said bow string, to buckle said at least one of said limb structures and effect a transmittal of energy from said flexed, at least one of said limb structures, to said first and other elongate energy storing means.

7. An archery apparatus as described in claim 5 wherein:

said eccentric member is pivotally mounted by said pivot means at an outer end of said at least one of said limb structures;

said energy transfer means is located at an inner end of said at least one of said limb structures.

8. An archery bow comprising:

a handle and limb assembly including an elongate handle member having spaced apart ends, and a pair of elongate resilient limbs connected to the ends of said handle member and projecting outwardly therefrom, said limbs having free terminal ends, support means mounted on said limbs adjacent the free terminal ends thereof;

said support means including a first pair of similar rotatable members, each rotatable member of said first pair of rotatable members being mounted on one of said limbs adjacent the end thereof;

a second pair of similar rotatable members each rotatable member of said second pair of rotatable members being revolvably and eccentrically mounted on said handle and limb assembly immediately adjacent an end of said handle member;

said rotatable members of said second par being located generally adjacent opposite ends of said handle member and said rotatable members of said first pair being located on said pair of limbs generally adjacent opposite ends of said handle and limb assembly;

a pair of concentric sheaves, each concentric sheave of said pair of concentric sheaves being fixedly connected to an associated one of said rotatable members and revolvable therewith;

an energy storing and releasing and bowstring assembly having opposite free ends thereof connected with said handle and limb assembly and being supported by said first and second pairs of rotatable members and defining a nocking stretch between said first pair of rotatable members, said nocking stretch being movable between drawn and rest positions, with said rotatable members of said first and second pair being revolvable in response to movement of the nocking stretch between the drawn and rest positions; and an elongate flexible, endless connecting cable trained about said spaced apart concentric sheaves to define a pair of stretches which cross each other and cooperate with said concentric sheaves to cause said second pair of rotatable members to rotate in unison in response to movement of the nocking stretch between drawn and rest position.

9. An archery apparatus including:

a hand grip and limb assembly including a hand grip, a first limb structure, a second limb structure, said hand grip structure interconnecting said first and second limb structures, with said first and second limb structures extending generally oppositely away from said hand grip structure;

a bow string structure;

support means located generally at each outer end of said first and second limb structures and operable to support said bow string structure therebetween;

energy storing and releasing means operable to store and release energy and connected with said bow string structure and extending generally longitudinally along each of said first and second limb structures; and energy storage and release, direction changing means operable to change the direction of energy storing and releasing in said energy storing and releasing means, said energy storage and release, direction changing means being carried by said hand grip and limb assembly and operable to cause said energy storing and releasing means to store and release energy in multiple directions extending generally longitudinally along each of said first and second limb structures;

said energy storing and releasing means being separate from, but connected with, said first and second limb structures and including, in association with and extending generally longitudinally energy transfer means interconnecting said first and second, elongate energy storing and releasing means in force transmitting communication and operable to transfer energy, generally transversely of the limb structure associated therewith, between said first and second, elongate energy storing and releasing means.

* * * * *